US005991578A

United States Patent [19]

Liu et al.

[11] Patent Number: 5,991,578

[45] Date of Patent: Nov. 23, 1999

[54] IMAGE FORMING REVERSE CHARGE PRINTING METHOD AND APPARATUS USING IMAGE AREA CENTERED PATCHES OF TONER

[75] Inventors: Chu-Heng Liu, Penfield; Weizhong Zhao, Webster, both of N.Y.

[73] Assignee: Xerox Corporation, Stamford, Conn.

[21] Appl. No.: 09/197,793

[22] Filed: Nov. 23, 1998

[51] Int. Cl.[6] ..... G03G 15/02

[52] U.S. Cl. ..... 399/169; 399/237

[58] Field of Search ..... 399/127, 128, 399/237, 296, 169, 183

[56] References Cited

U.S. PATENT DOCUMENTS

| | | | |
|---|---|---|---|
| 4,504,138 | 3/1985 | Kuehnle et al. . | |
| 5,387,760 | 2/1995 | Miyazawa et al. . | |
| 5,436,706 | 7/1995 | Landa et al. . | |
| 5,563,688 | 10/1996 | Bergen et al. | 399/169 |
| 5,619,313 | 4/1997 | Domoto et al. | 399/233 |
| 5,826,147 | 10/1998 | Liu et al. | 399/237 |

*Primary Examiner*—Mathew S. Smith
*Assistant Examiner*—Greg Moldafsky
*Attorney, Agent, or Firm*—Tallam I. Nguti

[57] ABSTRACT

An efficient and high quality image forming method and apparatus wherein only selective scattered portions of an imaging surface are charged with a first charging device, and then coated with a layer of charged toner solids by a toner supply apparatus, thereby forming an "image area patch of toner"; wherein each selected scattered portion is centered relative to, and has an area slightly exceeding an area to be imaged; each such charged and coated portion is then image-wise exposed to form a first latent image; each such coated portion is subsequently recharged by a reverse charge printing (RCP) second charging device in an image-wise manner to create a secondary latent image having toner solids in image areas charged to a first polarity, and toner solids in background areas charged to a second and opposite polarity; and finally the toner solids in the image areas thereof are then transferred onto a copy substrate for fixing as an output document, thus leaving a significantly diminished quantity of non-development toner for subsequent removal from the photoreceptor.

8 Claims, 5 Drawing Sheets

FIG. 2
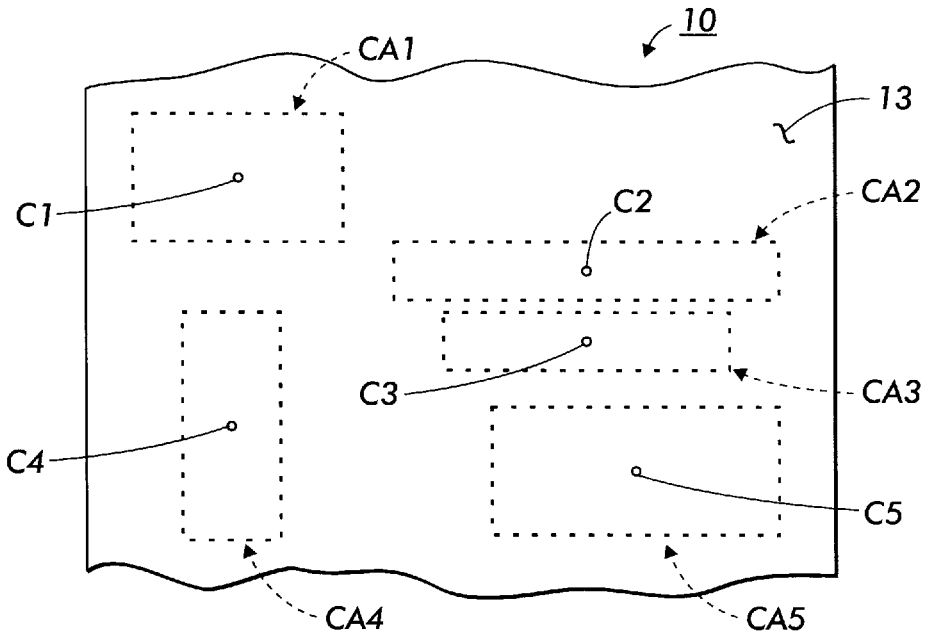
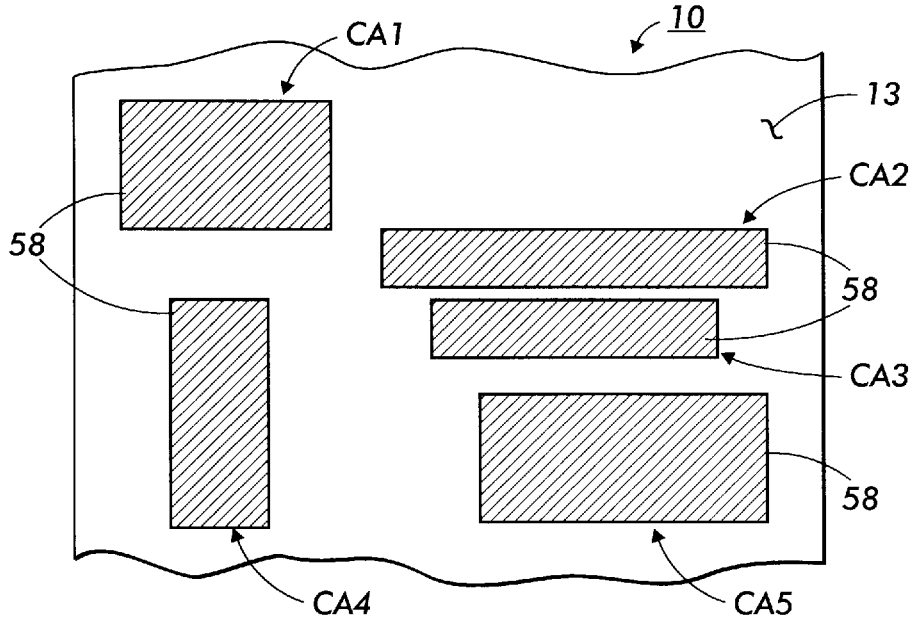
FIG. 3

IMAGE FORMING REVERSE CHARGE PRINTING METHOD AND APPARATUS USING IMAGE AREA CENTERED PATCHES OF TONER

RELATED CASES

This application is related to U.S. application Ser. No. 09/197,785 (Applicants' Docket NO. D/97345Q1) entitled "CONTACT ELECTROSTATIC PRINTING IMAGE FORMING METHOD AND APPARATUS USING IMAGE AREA CENTERED PATCHES OF TONER" filed on even date herewith; and U.S. application Ser. No. 09/197,753 (applicants' Docket NO. D/97345Q2) entitled "AIR BREAKDOWN CHARGE AND DEVELOPMENT IMAGE FORMING METHOD AND APPARATUS USING IMAGE AREA CENTERED PATCHES OF TONER" filed on even date herewith; and each having at least one common inventor.

BACKGROUND OF THE INVENTION

This invention relates generally to electrostatographic image forming methods, and more particularly, concerns a toner image forming apparatus and method for forming and developing an electrostatic latent image from an image area centered patch of developing or toner material coated on selectively charged portions of a photoreceptor. The method and apparatus advantageously diminish the quantity of non-development toner being handled by the machine during latent image development, and thus increases the efficiency of the machine as well as the quality of toner images formed.

Generally, processes for electrostatographic copying and printing are initiated by uniformly charging and selectively discharging a charge receptive photoreceptor in accordance with an original input document or an imaging signal, generating an electrostatic latent image on the photoreceptor. This latent image is subsequently developed into a visible image by a process in which charged developing material or toner solids are deposited onto the surface of the latent photoreceptor, wherein charged toner solids or particles in the developing material adhere to image areas of the latent image.

The developing material typically comprises carrier granules having marking or toner particles adhering triboelectrically thereto, wherein the toner particles are electrostatically attracted from the carrier granules to the latent image areas to create a powder toner image on the photoreceptor. Alternatively, the developing material may comprise a liquid developing material comprising a carrier liquid having pigmented marking particles (or so-called toner solids) and charge director materials dispersed and/or dissolved therein (so-called liquid toner), wherein the liquid developing material is applied to the latent image bearing photoreceptor with the marking particles being attracted to the image areas of the latent image to form a developed liquid image.

Regardless of the type of developing material employed, the toner or marking particles of the developing material are uniformly charged and electrostatically attracted to the latent image to form a visible developed image corresponding to the latent image on the photoreceptor. The developed image is subsequently transferred, either directly or indirectly, from the photoreceptor to a copy substrate, such as paper or the like, to produce a "hard copy" output document. In a final step, the photoreceptor is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface. It will be understood that the instant invention applies to all various types of electrostatic printing systems and is not intended to be limited by the manner in which the image is formed on the photoreceptor or the nature of the photoreceptor itself.

As described hereinabove, the typical electrostatographic printing process includes uniformly charging the entire surface of the photoreceptor, image-wise exposing the entire surface, and physically transporting developing material including charged marking or toner particles into contact with the photoreceptor so as to selectively develop the latent image areas thereon in an image-wise configuration. Development of the latent image is usually accomplished by electrostatic attraction of charged toner or marking particles to the image areas of the latent image.

The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

Numerous and various alternative methods of developing a latent image have been described in the art of electrophotographic printing and copying. Of particular interest with respect to the present invention is the concept of forming on a surface, a thin layer of liquid developing material having a high concentration of charged marking particles, with the layer being acted upon by image-wise forces, and being separated into image and background portions. For the purposes of the present description, the concept of latent image development via direct surface-to-surface transfer of a toner layer via image-wise forces will be identified generally as Contact Electrostatic Printing (CEP). Reverse charge printing (RCP), is one variant of CEP, wherein a thin layer of liquid developer material is recharged into opposite charge polarities in the image and background areas, such that a biased image separator can transfer a toner image therefrom onto its surface and leave toner corresponding to the background areas on a second surface. Because of the relatively large fraction of toner mass traditionally left in the background areas, cleaning and reuse of such toner from the background areas ordinarily can detrimentally affect the efficiency of the overall printing system.

The following sample references may be relevant as background art for the present invention. For example, U.S. Pat. No. 4,504,138 discloses a method of forming a latent electrostatic image on a uniformly charged surface, and developing the latent electrostatic image by applying a thin viscous layer of electrically charged toner particles to the electrostatic latent image. The apparatus includes an applicator roller mounted for rotation in a container for toner suspension, an electrode arranged adjacent the circumferential surface of the roller to define an electrodeposition chamber therebetween, and electrical connections between the roller, the electrode and a voltage source to enable electrolytic separation of toner particles in the chamber, thus forming a thin highly viscous layer of concentrated toner particles on the roller.

U.S. Pat. No. 5,387,760 discloses a wet development apparatus for use in a recording machine to develop a toner image corresponding to an electrostatic latent image on a uniformly charged electrostatic latent image carrying member or carrier. The apparatus includes a development roller disposed in contact with or near the electrostatic latent image carrier and an application head for applying a uniform layer of wet developer material to the roller.

U.S. Pat. No. 5,436,706 discloses an imaging apparatus including a first member having a first uniformly charged surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selectively transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, uniformly applying a layer of charge having a second electrical potential onto the charge bearing surface, and image-wise dissipating charge from portions on the charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving photoreceptor to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor. In each of the sample types of references, the toner layer is formed or developed uniformly After the development, the toner materials in the areas that correspond to the background need to be fully recovered in order to be used for subsequent development processes. In addition, in each of the sample references, the photoreceptor is typically charged uniformly, meaning that the entire surface of the photoreceptor is charged. Subsequently, non-image or background areas, for example, are then discharged in order to prevent them from being developed with non-image developing toner, along with image areas. In each of these references, image quality and inefficiency of the method and apparatus are therefore concerns. Image quality for example is a concern because it may vary significantly due to numerous conditions affecting latent image formation as well as latent image development. In particular, image development can be affected by charge levels, both in the latent image, as well as in the developing material. For example, when the charge on dry toner particles becomes significantly depleted, binding forces with the carrier also become depleted, causing an undesirable increase in image development, which, in turn, causes the development of the latent image to spread beyond the area defined thereby.

Inefficiency in an image forming method and apparatus is impacted significantly, for example, by the quantity or volume of non-development or unused charged toner material that is applied to the photoreceptor and moved through the development nip. Such non-development charged toner can undesirably affect charge levels of cooperating elements, and of course has to be removed or cleaned subsequently from the photoreceptor in order to ready the photoreceptor for recharging and reuse. Such cleaning or removal efforts involve inefficiencies in themselves, and it is of course time consuming and costly to recycle or dispose of such non-development or unused charged toner after it has been applied to the photoreceptor, and moved through the development nip.

SUMMARY OF THE INVENTION

In accordance with one aspect of the present invention, there is provided a method in a liquid toner development machine for forming toner images efficiently by significantly reducing a quantity of non-development toner applied to a photoreceptor. The method includes selectively charging only image area centered and scattered portions of a photoreceptor surface in order to increase the efficiency of the method by significantly reducing a quantity of non-development toner applied to the photoreceptor; applying a layer of marking material onto each scattered charged portion of the photoreceptor surface, thereby forming an "image area centered patch" (IACP) of marking material. The method then includes using an exposure device connected to a controller for image-wise generating a first electrostatic latent image within each IACP of marking material, such that a first electrostatic latent image is formed including image areas defined by a first charge voltage and background areas defined by a second charge voltage distinguishable from a first charge voltage. The method next includes using a second charging device for selectively delivering charges to each such image area centered patch (IACP) of marking material in an imagewise manner responsive to the first electrostatic latent image thereof, thus forming a secondary latent image in a marking material of each IACP corresponding to the first electrostatic latent image under the IACP, thus recharging the IACP and resulting in image area toner solids having a first polarity, and in background area toner solids having a second and opposite polarity. The method then includes using a biased separator member for selectively separating the image area toner solids from the background toner solids, thereby resulting in an efficiently produced, quality toner image with significantly reduced non-development marking material generated and requiring removal.

In accordance with another aspect of the present invention, there is provided a liquid toner development machine for forming toner images efficiently by significantly reducing a quantity of non-development toner applied to the photoreceptor. The liquid development machine includes an electronic control subsystem or controller for controlling various operations of the machine, and a photoreceptor having a surface capable of supporting electrostatic charge and a coat of marking material. A first charging device connected to the controller is provided and controlled for selectively charging only scattered portions of the photoreceptor surface in order to increase the efficiency of the method by significantly reducing a quantity of non-development toner applied to the photoreceptor. Each charged scattered portion preferably is centered on, and has an area that slightly exceeds an area to be imaged on the photoreceptor. A marking material coating apparatus is then provided for applying a layer of marking material onto the scatteredly charged photoreceptor surface, thereby forming an "image area centered patch" (IACP) of marking material. The printing machine then includes an exposure device connected to the controller for image-wise generating a first electrostatic latent image within each charged scattered portion on the surface of the photoreceptor, such that the first electrostatic latent image includes image areas defined by a first charge voltage and background areas defined by a second charge voltage distinguishable from the first charge voltage. A second charging device is then provided for selectively delivering charges to each such image area centered patch (IACP) of marking material in an image-wise manner responsive to the first electrostatic latent image thereof, thus forming a secondary latent image in the marking material of each IACP corresponding to the first electrostatic latent image under the IACP. The IACP of making material is thus recharged and results in image area toner solids having a first polarity, and in background area toner solids having a second and opposite polarity. A biased separator member is then provided for selectively separating the image area toner solids from the background toner solids, thereby resulting in an efficiently produced, quality toner image with significantly reduced non-development marking material generated and requiring removal.

BRIEF DESCRIPTION OF THE DRAWINGS

These and other aspects of the present invention will become apparent from the following description in conjunction with the accompanying drawings in which:

FIG. 2 is an illustration of scattered image area centered portions of the surface of the photoreceptor of the machine of FIG. 1, charged by a first charging device in accordance with the present invention;

FIG. 3 is an illustration of the scattered image area centered portions of the surface of the photoreceptor of the machine of FIG. 1, showing toner coated thereon to form Image Area Centered Patches of toner in accordance with the present invention;

DETAILED DESCRIPTION OF THE INVENTION

While the present invention will be described in terms of an illustrative embodiment, it will be understood that the invention is adaptable to a variety of copying and printing applications, and is not necessarily limited to the particular embodiment shown and described herein. On the contrary, the following description is intended to cover all alternatives, modifications, and equivalents, as may be included within the spirit and scope of the invention as defined by the appended claims.

Figure 1:
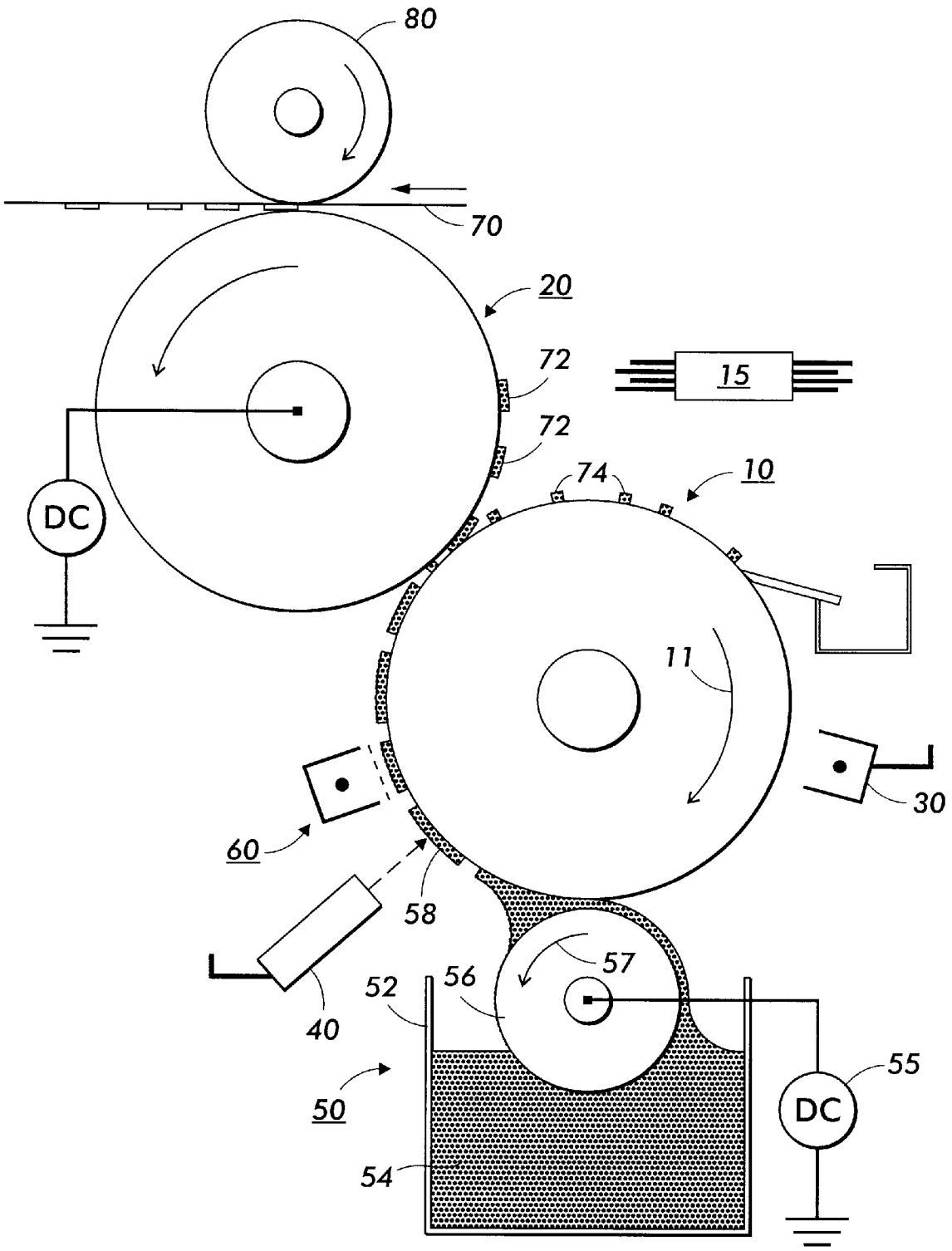
FIG. 1 is a simple schematic illustration depicting a liquid printing machine for forming toner images using image area centered patches of toner in accordance with the present invention.

Referring now to FIGS. 1 and 2, a liquid printing machine and parts thereof, capable of forming toner images in accordance with the present invention are illustrated. As shown, the printing machine includes an assemblage of operatively associated image forming and control elements, including an photoreceptor 10, and an electronic control subsystem or controller 15 for controlling the operations of various elements of the machine.

Photoreceptor 10 includes an imaging surface 13 of any type capable of supporting electrostatic charges and an electrostatic latent image formed thereon. Although the following description will be directed by example to a system and process incorporating a photoconductive photoreceptor, it will be understood that the present invention contemplates the use of various alternative embodiments for a photoreceptor as are well known in the art of electrostatographic printing, including, for example, but not limited to, non-photosensitive photoreceptors such as a dielectric charge retaining member of the type used in ionographic printing machines, or electroded substructures capable of generating charged latent images.

Photoreceptor 10 is rotated, as indicated by arrow 11, so as to transport the surface 13 thereof in a process direction for implementing a series of image forming steps in accordance with the method of the present invention. Initially, the photoconductive surface 13 is moved through a charging station, which is shown including a corona generating first charging device 30. Importantly, the first charging device 30 is connected to the controller 15 for further enabling it to apply electrostatic charge to scattered selective portions shown in FIG. 2 as CA1, CA2, CA3, CA4, and CA5, of the surface 13 of the photoreceptor 10. FIG. 2 is an illustration of scattered image area centered portions, of the surface 13 of the photoreceptor 10, that have been charged by the first charging device 30 in accordance with the present invention. The corona generating first charging device 30 preferably is capable of charging such each selective portion of the photoconductive surface to a relatively high potential.

Importantly too, each such charged scattered selective portion CA1, CA2, CA3, CA4, and CA5 is centered on, or has a common center C1, C2, C3, C4 and C5, respectively with a corresponding area of the surface 13, which (as pre-determined by the controller 15), is to be imaged in subsequent steps. Such pre-determination can be based on information or image data about a finished toner image sheet or page for which a particular section or image frame of the surface 13 is being processed.

Referring now to FIGS. 1 and 3, the surface 13 of the photoreceptor 10 with the charged scattered selective portions CA1, CA2, CA3, CA4, and CA5 thereon, is then advanced to a toner solids coating station that includes a toner supply and coating apparatus 50. In accordance with an aspect of the present invention, the apparatus 50 supplies and applies a thin coat of charged marking or toner particles to each charged scattered selective portions CA1, CA2, CA3, CA4, and CA5, thus producing a scattered or non-uniform pattern of image area centered patches 58 of toner solids (FIG. 3) on the surface 13 of the photoreceptor 10.

As further shown in FIG. 1, the toner supply and applicator apparatus 50 includes a housing 52 that is adapted to accommodate a supply of toner particles 54 and any additional carrier material, if necessary. The apparatus 50 also includes an applicator roller 56 which is rotated in a direction as indicated by arrow 57 to transport toner from housing 52 into contact with the surface of the photoreceptor 10, onto which it forms a toner solids coat onto each charged scattered selective portions CA1, CA2, CA3 CA4, and CA5, thus producing a scattered or non-uniform pattern of image area centered patches of toner "cake" or toner solids 58 (FIG. 3) on the surface 13 of the photoreceptor 10.

The toner "cake" or toner solids coat 58 described above can be created in various ways. For example, depending on the materials utilized in the printing process, as well as other process parameters such as process speed and the like, a coating of toner particles having sufficient thickness, preferably on the order of between 2 and 15 microns and more preferably between 3 and 8 microns, may be formed on the surface of the photoreceptor 10 by employing electrical biasing to assist in actively moving the charged toner particles or solids from the applicator 56 onto the latent image portions of the surface of the photoreceptor 10. Therefore, the applicator roller 56 is preferably coupled to an electrical biasing source 55 for implementing a so-called forward biasing scheme, wherein the toner applicator 56 is provided with an electrical bias of magnitude sufficient to create electrical fields extending from the toner applicator roll 56 to the selected latent image portions on the surface of the photoreceptor 10, thus creating the toner "cake" or toner solids coat 58 described above. As illustrated in FIG. 1, the image area centered patches of toner are formed as a response to the scattered charged patterns on the photoreceptor. The image area centered patch of toner described above can be created in various ways other than illustrated in FIG. 1.

Figure 4:
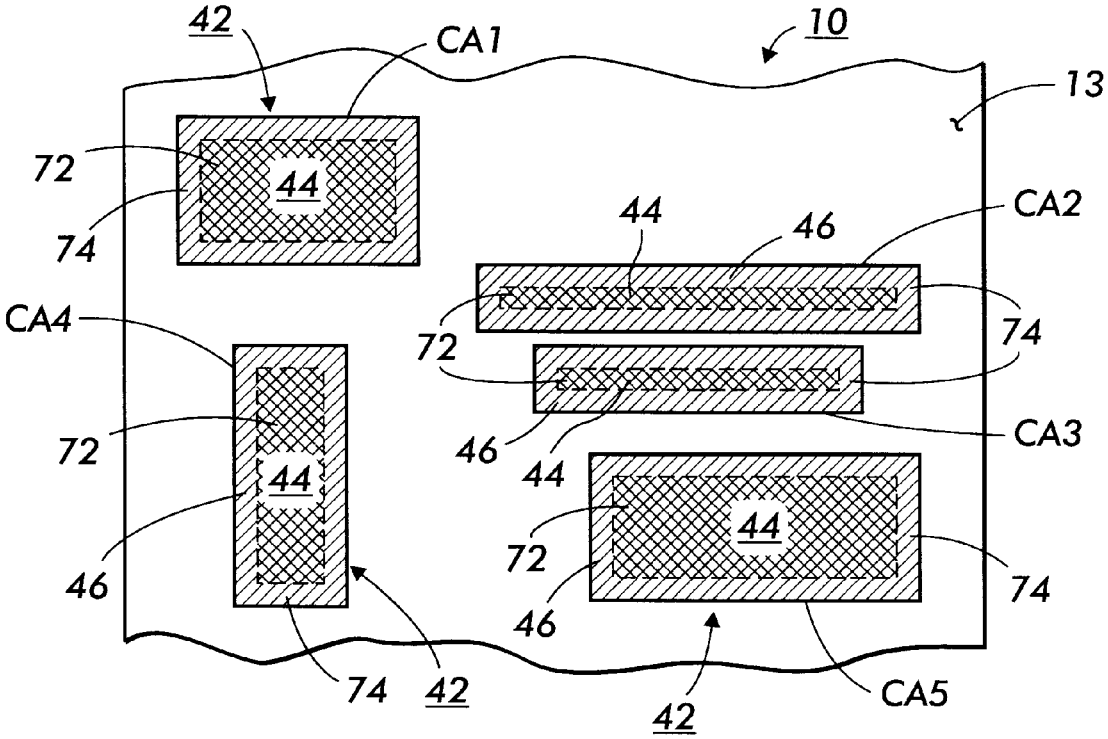
FIG. 4 is an illustration of the charged and coated scattered image area centered portions of the surface of the photoreceptor of the machine of FIG. 1, image-wise exposed in accordance with the present invention.

Referring now to FIGS. 1 and 4, the printing machine includes an exposure device 40 that is connected to the controller 15 for image-wise exposing each charged scattered selective portion CA1, CA2, CA3, CA4, and CA5 with patches of toner thereon to form a first latent image 42 having image areas 44 and background areas 46. The surface 13 of the photoreceptor 10 with the charged scattered selective portion CA1, CA2, CA3, CA4, and CA5 thereon is then advanced to the exposure device 40 which projects a light image onto each such portion corresponding to an input image to be reproduced thereon. In the case of an imaging system having a photosensitive photoreceptor, as currently described, the light image projected onto the charged and coated scattered selective portions with patches of toner thereon, CA1, CA2, CA3, CA4, and CA5 of the surface 13, selectively dissipates charges in sections thereon for recording the first electrostatic latent image 42 on each such portion. Each such first electrostatic latent image 42 thus comprises an image area 44 defined by a first charge voltage, and a background area 46 defined by a second charge voltage.

In accordance with the present invention, a reverse charge printing (RCP) method and apparatus, including a second charging device 60 are then employed downstream of the apparatus 50 for completing efficient formation of a final toner image. RCP (Reverse Charge Printing) method and apparatus per se for forming an initial developed toner image from a uniform layer or cake of toner are disclosed for example in U.S. Pat. No. 5826147 issued Oct. 20, 1998 in the name of the current inventors, (relevant parts of which are incorporated herein by reference). As disclosed therein, RCP employs uniformly charging an entire photoreceptor surface, forming a latent image thereon, uniform, non-image toner layer coating, a charging or an ion generating device for producing positive or negative ions for image-wise application to background areas and image areas of the coated latent image, and a separation roll.

Specifically, U.S. Pat. No. 5826147 discloses a novel image development method and apparatus, wherein an imaging member having an imaging surface is provided with a uniform layer of marking material thereon, and an electrostatic latent image is created in the layer of marking material. Image-wise charging of the layer of marking material is accomplished by a wide beam ion source such that free mobile ions are introduced in the vicinity of an electrostatic latent image associated with the imaging member having the layer of marking material coated thereon. The latent image associated with the imaging member causes the free mobile ions to flow in an image-wise ion stream corresponding to the latent image, which, in turn, leads to image-wise charging of the toner layer, such that the toner layer itself becomes the latent image carrier. The latent image carrying toner layer is subsequently developed and transferred to a copy substrate to produce an output document.

Thus in accordance with the present invention, after the image area centered patches of toner 58 are formed on the surface 13 of the photoreceptor 10, they are then recharged in an image-wise manner by a second charging device 60, represented schematically in FIG. 1 as a well known scorotron device connected to the controller 15. In operation, the second charging device 60 introduces free mobile ions in the vicinity of each image area centered patch of toner 58 in the form of image-wise ion streams extending from the source 60 to the surface 13 of the photoreceptor 10. The image-wise ion streams generate a secondary latent image in each image area centered patch of toner 58 that comprises image areas 44 made up of toner solids 72 having a first polarity, and background areas 46 made up of toner solids 74 having a second and reversed or opposite polarity.

The process of generating a secondary latent image in the toner "cake" 58 of each image area centered patch of toner, will be described in greater detail with reference to FIG. 5. As shown, the image area centered patches (IACP) of toner solids 58 (as formed by the apparatus 50), for purposes of simplicity only, are shown as a uniformly distributed layer of negatively charged toner, single polarity solids having the thickness of a single toner particle on the surface 13. The surface of the photoreceptor 10 is being transported from left to right past the broad source ion second charging device 60. As previously described, the primary function of the broad source ion second charging device 60 is to provide free mobile ions in the vicinity of "cake" 58 on the photoreceptor 10.

Figure 5:
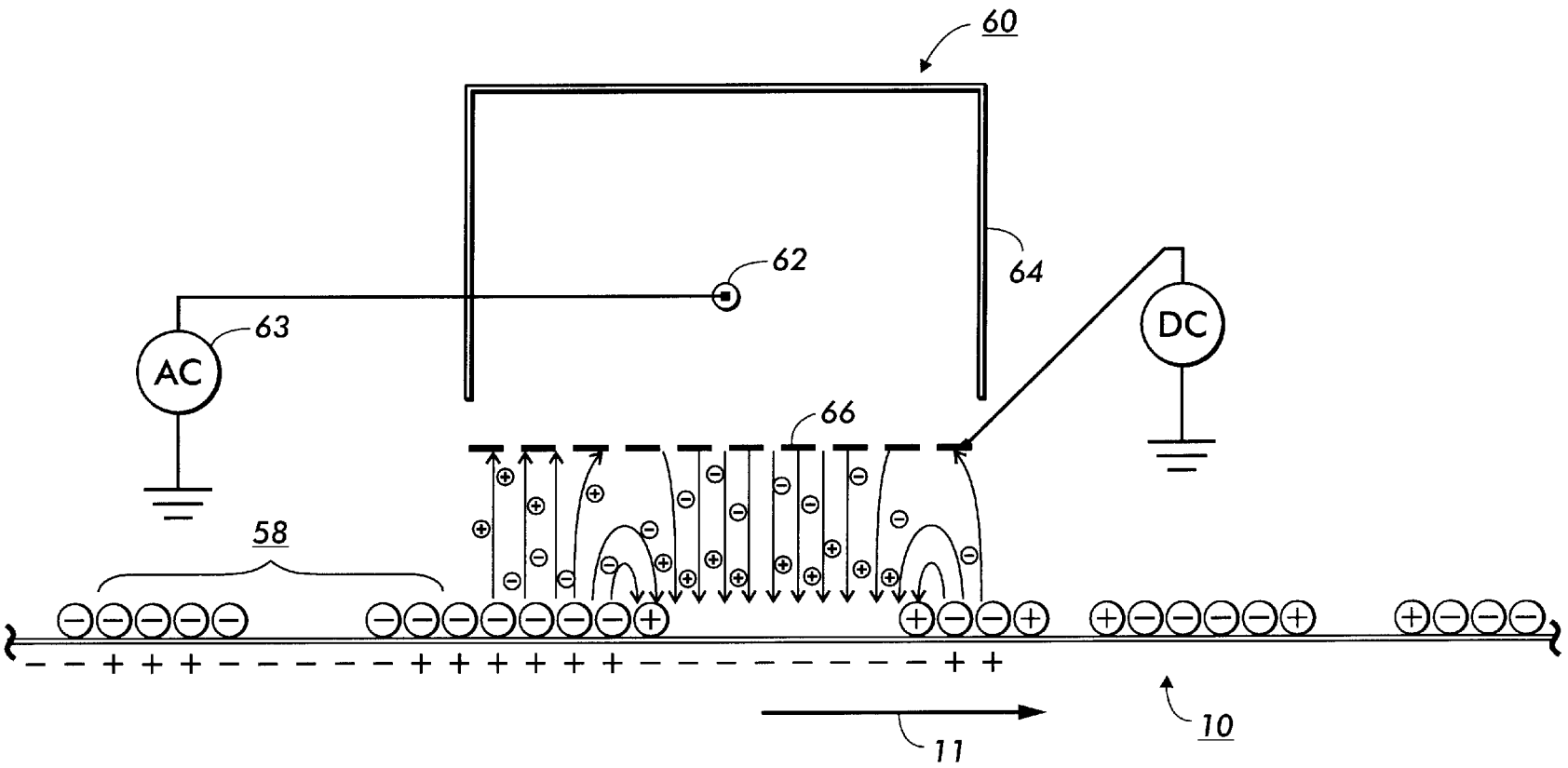
FIG. 5 is an exploded view illustrating image-wise recharging of the image area centered patches of toner of FIG. 4 being recharged by a Reverse Charge printing (RCP) second charging device in accordance with an aspect the present invention.
Figure 6:
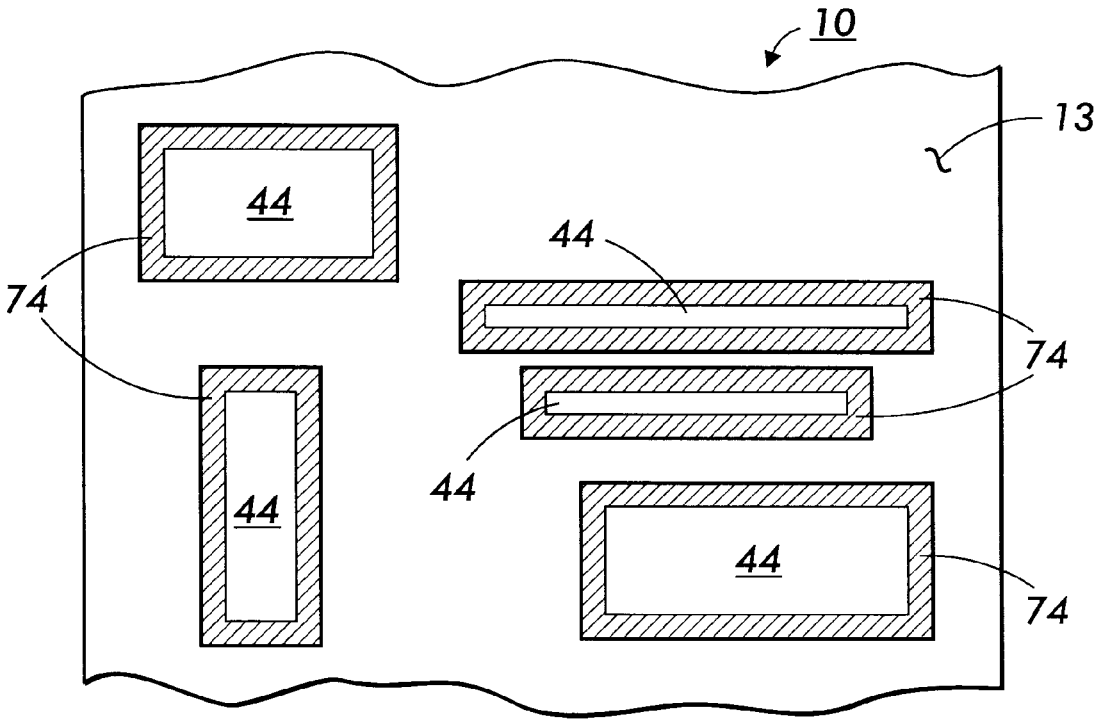
FIG. 6 is an illustration of significantly reduced or diminished non-development or residual toner left of each scattered image area centered patch of toner on the surface of the photoreceptor of the machine of FIG. 1, following image formation and transfer in accordance with the present invention.

In the embodiment shown in FIG. 5, the scorotron device 60 is shown as including a corona generating electrode 62 enclosed within a shield member 64 surrounding the electrode 62 on three sides. A wire grid 66 covers the open side of the shield member 64 facing the photoreceptor 10. In operation, the corona generating electrode 62, otherwise known as a coronode, is coupled to an electrical biasing source 63 capable of providing a relatively high voltage potential to the coronode, which causes electrostatic fields to develop between the coronode 62 and the grid and the photoreceptor 10. The force of these fields causes the air immediately surrounding the coronode to become ionized, generating free mobile ions which are repelled from the coronode toward the grid 66 and the photoreceptor 10. As is well known to one of skill in the art, the scorotron grid 66 is biased so as to be operative to control the amount of charge and the charge uniformity applied to the imaging surface 10 by controlling the flow of ions through the electrical field formed between the grid and the imaging surface.

With respect to the process illustrated by FIG. 5, it will be seen that the function of the charging device 60 is to charge each image area centered patch of toner 58 in an image-wise manner. This process will be described with respect to a negatively charged image area centered patch of toner, although it will be understood that the process can also be implemented using a positively charged toner. The process of the present invention requires that second charging device 60 provide ions having a charge opposite that of toner solids forming each image area centered patch of toner leaving the apparatus 50.

Thus, in the case of negatively charged patches of toner 58, as shown in FIG. 5, the scorotron 60 is preferably provided with an energizing bias at grid 66 intermediate the potential of the image and non-image areas of the latent image under each patch. Under certain circumstances, such as when the charge on the image area centered patch of toner is sufficient to prevent charge reversal due to injected wrong sign charge, the energizing bias at the grid 66 can be higher or lower than the bias of the image and background areas of the latent image. In addition, the energizing bias applied to grid 66 can be provided in the form of either a direct current (DC) electrical bias or an alternating current (AC) bias having a DC offset.

Operatively, in areas where the first latent image of each portion CA1, CA2, CA3, CA4 and CA5 is at a potential lower than the bias potential of the charging source grid 66, the bias potential generates electrostatic field lines in a direction toward the photoreceptor 10 and thus toward the image area centered patches of toner 58 thereon. Conversely, electrostatic field lines are generated in a direction away from the photoreceptor 10 and thus away from the image area centered patches of toner 58 thereon in areas where the latent first image is at a potential higher than the bias potential of the charging source grid 66.

FIG. 5 illustrates the effect of the field lines in the case of an ion source energized by an AC voltage having a DC grid bias 66 voltage intermediate to the image and background areas of the latent image, represented by (+) and (−) signs, respectively, on the back side of the photoreceptor 10. As illustrated, positive ions flow from the ion source 60 in the direction of the field lines while negative ions (electrons) flow in a direction opposite to the direction of the field lines such that positive ions presented in the vicinity of a positively charged area of the latent image are repelled from the image area centered patches of toner 58. Meanwhile the positive ions in the vicinity of a negatively charged area of the latent image are attracted to the image area centered patches of toner 58, thereby reversing the charge polarity of the toner in the background areas.

Conversely, negative ions presented in the vicinity of a positively charged area of the first latent image are attracted to the photoreceptor 10 and absorbed into the negatively charged toner solids of the patch 58 thereby enhancing the toner charge in that area, while the negative ions in the vicinity of a negatively charged area of the first latent image are repelled by the image area centered patches of toner. The free flowing ions generated by the ion source 60 are captured by image area centered patches of toner 58 in a manner corresponding to the first latent image on the photoreceptor, thus causing image-wise recharging of each image area centered patch of toner 58. Such recharging creates a secondary latent image within each image area centered patch of toner 58, that is charged oppositely in charge polarity compared to the charge polarity of the first latent image. Under optimum conditions, the charge associated with the first latent image will be captured and converted into the secondary latent image in the image area centered patches of toner 58 such that the first electrostatic latent image is substantially or completely dissipated into the image area centered patches of toner 58.

Once the secondary latent image is formed as above by the device 60 in each image area centered patch of toner 58, the surface is advanced to the image separator 20. Referring back to FIG. 1, image separator 20 may be provided in the form of a biased roll member having a surface adjacent to the surface of the photoreceptor 10 and preferably contacting each image area centered patch of toner 58 residing on photoreceptor 10. An electrical biasing source is coupled to the image separator 20 to bias the image separator 20 so as to attract either image or background areas of the image area centered patch of toner 58 for simultaneously separating and developing each patch of toner 58 into image and background areas.

In FIG. 1, the image separator 20 is biased with a polarity opposite the charge polarity of the image areas in each image area centered patch of toner 58, for attracting such image areas thereto from the surface 13, thereby producing a final developed toner image made up of the selectively separated and transferred image areas 44 (toner solids 72) of the toner cake 58 on the surface of the image separator 20. This of course leaves background areas 46 (toner solids) 74 of the cake 58 on the surface of the photoreceptor 10. Alternatively, the image separator 20 can be provided with an electrical bias having a polarity appropriate for attracting background areas 46 (toner solids 74) away from the photoreceptor 10, thereby leaving the image areas 44 (toner solids 72) on the surface of the photoreceptor 10.

After the developed image is created, either on the surface of the photoreceptor 10 or on the surface of the imaging separator 20, the developed image may then be transferred to a copy substrate 70 via any means known in the art, which may include an electrostatic transfer apparatus including a corona generating device of the type previously described or a biased transfer roll. Alternatively, a pressure transfer system may be employed which may include a heating and/or chemical application device for assisting in the pressure transfer and fixing of the developed image on the output copy substrate 70. In a preferred embodiment, as shown in FIG. 1, the image is transferred to a copy substrate 70 via a heated pressure roll 80, whereby pressure and heat are simultaneously applied to the image to simultaneously transfer and fuse the image to the copy substrate 70.

As can be seen, there is provided an electrostatographic image forming method wherein to start, only selective scattered portions of a surface of a photoreceptor (and not the entire surface) are charged by a controlled first charging device in order to increase the efficiency of the method by significantly reducing the quantity of non-development toner applied to the photoreceptor. Each of the selected scattered portions is preferably centered relative to, and has an area that slightly exceeds an area to be imaged on the photoreceptor. A layer of marking material or toner is coated onto each charged portion, thereby forming an "image area centered patch of toner" (IACP), or "image area centered patch of marking material or toner particles" thereon. Each such selected charged portion is then image-wise exposed to form a first latent image Each IACP is subsequently recharged by a controlled second charging device in an image-wise manner to create a secondary latent image therein in response to the first latent image thereof. Recharging of the IACP is accomplished by a wide beam charge source for introducing free mobile charges or ions into the vicinity of the IACP or image area centered patch of marking material or toner particles. The first latent image of the IACP causes the free mobile charges or ions to flow in an image-wise stream corresponding to such first latent image. These mobile charges or ions are captured by the marking material or toner particles forming each IACP, leading to image-wise recharging of such marking material or toner particles. As a result, the IACP or image area centered patch of toner itself becomes image-wise recharged resulting in image area toner solids having a first polarity, and background toner solids having a second and opposite polarity. Subsequently, the recharged IACP of toner particles is selectively separated into image area toner solids and background area toner solids, and the image areas thereof are then transferred onto a copy substrate for fixing as an output document.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. An efficient electrostatographic image forming method wherein a quantity of non-development toner being applied to a photoreceptor is significantly diminished, the method comprising the steps of:

(a) selectively charging only scattered portions of a surface of said photoreceptor using a first charging device connected to a controller;

(b) applying a coat of charged toner solids having a single polarity onto each charged selected scattered portion, thereby forming an image area patch of toner;

(c) image-wise exposing each said image area centered patch of toner to form a first latent image having image areas and background areas;

(d) recharging each exposed said image area patch of toner in an image-wise manner to create a secondary latent image therein so that the image patch area patch of toner then includes image area toner solids having a first polarity, and background toner particles having a second and opposite polarity; and (e) separating the image area toner solids having the first polarity from the background toner solids having the second and opposite polarity, and transferring the image area toner solids onto a copy substrate, thereby resulting in an efficiently produced, quality toner image with significantly reduced non-development marking material generated and requiring removal.

2. The method of claim 1, wherein said selectively charging step comprises selectively charging said scattered portions that are each centered relative to an area of the surface of the photorecepter to be imaged.

3. The method of claim 1, wherein said selectively charging step comprises selectively charging said scattered portions that are each centered relative to an area of the surface of the photorecepter to be imaged, and wherein each charged selected scattered portion slightly exceeds the area to be imaged.

4. A printing machine for efficiently forming toner images such that a quantity of non-development toner applied to a photoreceptor of the machine is significantly diminished, the printing machine comprising:

(a) a movable photoreceptor having a photoconductive surface for supporting electrostatic charge and a toner image;

(b) a first charging device for selectively charging only scattered portions of said surface of said photoreceptor;

(c) a liquid developer material supply and application apparatus for applying a coat of charged toner solids having a single polarity onto each charged selected scattered portion, thereby forming an image area patch of toner;

(d) an exposure device for image-wise exposing said image area patch of toner;

(e) a reverse charge printing (RCP) assembly including a second charging device for recharging each said image area patch of toner in an image-wise manner to create a secondary latent image therein so that said image area patch of toner then includes image area toner solids having a first polarity, and background toner solids having a second and opposite polarity; and (f) a biased separator member for separating said image area toner solids having said first polarity from said background area toner solids having said second and opposite polarity, and for transferring said image area toner solids onto a copy substrate, thereby resulting in an efficiently produced, quality toner image with significantly reduced non-development marking material generated and requiring removal.

5. The printing machine of claim 4, wherein said second charging device is adapted to introduce an image-wise ion stream of free mobile ions directed toward each said image area centered patch of toner on the photoreceptor.

6. The printing machine of claim 4, wherein said second charging device includes a DC biasing source coupled thereto for providing a biasing voltage to said second charging device to generate ions having a single charge polarity.

7. The printing machine of claim 4, wherein each said charged selected scattered portion is each centered relative to an area of the surface of the photorecepter to be imaged.

8. The printing machine of claim 4, wherein each said selected charged scattered portion is each centered relative to an area of the surface of the photorecepter to be imaged, and each selected charged scattered portion slightly exceeds the area to be imaged.

* * * * *